US008172568B2

(12) United States Patent
Kashihara et al.

(10) Patent No.: US 8,172,568 B2
(45) Date of Patent: May 8, 2012

(54) COMBUSTOR

(75) Inventors: Hiroyuki Kashihara, Kobe (JP); Yasushi Yoshino, Kobe (JP); Kiyoshi Matsumoto, Kobe (JP); Takeshi Kimura, Kobe (JP); Junichi Kitajima, Akashi (JP); Atsushi Horikawa, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 12/700,519

(22) Filed: Feb. 4, 2010

(65) Prior Publication Data

US 2010/0136496 A1 Jun. 3, 2010

Related U.S. Application Data

(63) Continuation of application No. PCT/JP2008/001989, filed on Jul. 25, 2008.

(30) Foreign Application Priority Data

Aug. 10, 2007 (JP) ..... 2007-210269

(51) Int. Cl.
*F23R 3/00* (2006.01)
*F23R 3/34* (2006.01)

(52) U.S. Cl. ..... 431/285; 431/278; 431/284; 431/350; 431/8; 431/9; 431/115; 60/39.826; 60/722; 60/737; 60/739; 60/746; 60/750

(58) Field of Classification Search ..... 431/278, 431/284, 285, 350, 8, 9, 115; 60/39.826, 60/722, 737, 739, 746, 750
See application file for complete search history.

(56) References Cited

U.S. PATENT DOCUMENTS

| | | | | |
|---|---|---|---|---|
| 47,426 | A * | 4/1865 | Jones | 431/346 |
| 554,253 | A * | 2/1896 | Finlay | 431/346 |
| 1,595,995 | A * | 8/1926 | Clefton | 431/346 |
| 2,001,739 | A * | 5/1935 | MacGregor | 431/346 |
| 2,582,577 | A * | 1/1952 | Zink et al. | 239/132.5 |

(Continued)

FOREIGN PATENT DOCUMENTS

DE 19505614 A1 * 8/1996

(Continued)

OTHER PUBLICATIONS

International Search Report for International Application No. PCT/JP2008/001989, dated Sep. 2, 2008.

(Continued)

*Primary Examiner* — Carl Price
(74) *Attorney, Agent, or Firm* — Sughrue Mion, PLLC

(57) ABSTRACT

A combustor, in which a flame holding region is formed at a location distant from a pilot burner to avoid burnout of the pilot burner and in which flame holding capability is increased to use a lean pre-mix gas for reducing NOx emission, is provided. The combustor includes a combustion liner having a cylindrical side wall that defines a combustion chamber; and a main burner positioned at a top portion of the combustion liner for injecting an annular pre-mix gas into the combustion chamber to form a reverse flow region at a downstream portion thereof, which region is oriented towards the top portion of the combustion chamber along a longitudinal axis. In this combustor, a pilot burner is arranged at the top portion for injecting a mixture of fuel and air only in a direction confronting the reverse flow region.

9 Claims, 5 Drawing Sheets

U.S. PATENT DOCUMENTS

| | | | | | |
|---|---|---|---|---|---|
| 4,082,497 | A | * | 4/1978 | Crawford et al. | 431/158 |
| 4,095,929 | A | * | 6/1978 | McCartney | 431/19 |
| 4,224,019 | A | * | 9/1980 | Dilmore | 431/328 |
| 4,237,694 | A | * | 12/1980 | Wood et al. | 60/738 |
| 4,373,896 | A | * | 2/1983 | Zwick et al. | 431/9 |
| 4,752,213 | A | * | 6/1988 | Grochowski et al. | 431/328 |
| 5,165,241 | A | * | 11/1992 | Joshi et al. | 60/737 |
| 5,284,438 | A | * | 2/1994 | McGill et al. | 431/9 |
| 5,299,930 | A | * | 4/1994 | Weidman | 431/10 |
| 5,319,923 | A | * | 6/1994 | Leonard et al. | 60/39.23 |
| 5,450,725 | A | * | 9/1995 | Takahara et al. | 60/737 |
| 5,515,680 | A | * | 5/1996 | Fujimura et al. | 60/737 |
| 5,611,684 | A | * | 3/1997 | Spielman | 431/353 |
| 5,623,819 | A | * | 4/1997 | Bowker et al. | 60/776 |
| 5,718,573 | A | * | 2/1998 | Knight et al. | 431/354 |
| 6,022,213 | A | * | 2/2000 | Harthun | 431/158 |
| 6,098,407 | A | * | 8/2000 | Korzendorfer et al. | 60/737 |
| 6,363,726 | B1 | | 4/2002 | Durbin et al. | |
| 6,532,742 | B2 | * | 3/2003 | Scarinci et al. | 60/725 |
| 6,889,495 | B2 | * | 5/2005 | Hayashi et al. | 60/39.37 |
| 2005/0268618 | A1 | | 12/2005 | Johnson et al. | |

FOREIGN PATENT DOCUMENTS

| | | | | |
|---|---|---|---|---|
| EP | 534684 | A1 | * | 3/1993 |
| EP | 534685 | A1 | * | 3/1993 |
| EP | 686813 | A2 | * | 12/1995 |
| EP | 1193450 | A1 | | 4/2002 |
| JP | 57175822 | A | * | 10/1982 |
| JP | 60064130 | A | * | 4/1985 |
| JP | 04098014 | A | * | 3/1992 |
| JP | 05264037 | A | * | 10/1993 |
| JP | 06018038 | A | * | 1/1994 |
| JP | 06129641 | A | * | 5/1994 |
| JP | 06213445 | A | * | 8/1994 |
| JP | 07-190373 | A | | 7/1995 |
| JP | 07233945 | A | * | 9/1995 |
| JP | 08005076 | A | * | 1/1996 |
| JP | 08-028871 | A | | 2/1996 |
| JP | 08-210641 | A | | 8/1996 |
| JP | 10054560 | A | * | 2/1998 |
| JP | 10089689 | A | * | 4/1998 |
| JP | 11-264543 | | * | 9/1999 |
| JP | 2000-274611 | A | | 10/2000 |
| JP | 2001235153 | A | * | 8/2001 |
| JP | 2002-168449 | A | | 6/2002 |
| JP | 2002-174425 | A | | 6/2002 |
| JP | 2002206744 | A | * | 7/2002 |
| JP | 2005-030667 | A | * | 2/2005 |
| JP | 2005030667 | A | * | 2/2005 |
| JP | 2005-351616 | A | | 12/2005 |

OTHER PUBLICATIONS

International Preliminary Report on Patentability and Written Opinion of the International Searching Authority dated Mar. 4, 2010, issued in PCT/JP2008/001989.

* cited by examiner

COMBUSTOR

CROSS REFERENCE TO THE RELATED APPLICATION

This application is a continuation application, under 35 U.S.C. §111(a), of international application No. PCT/JP2008/001989, filed Jul. 25, 2008, which claims priority to Japanese patent application No. 2007-210269, filed Aug. 10, 2007, the disclosure of which is incorporated by reference in its entirety into this application.

BACKGROUND OF THE INVENTION

1. Field of the Invention

The present invention relates to a combustor for use in machines and equipments that require a feed of a high temperature gaseous medium to, for example, a gas turbine engine or a boiler.

2. Description of the Related Art

In the field of gas turbine engines, for due consideration to the environmental protection, severe standards have been stipulated on the composition of exhaust gases emitted as a result of combustion taking place therein and, hence, reduction of hazardous substances such as, nitrogen oxides (hereinafter referred to as NOx) is required. On the other hand, in heavy duty gas turbines and aircraft engines, the pressure ratio is increasingly set to be high to accommodate demands for low fuel consumption and high output capacity. In consistency therewith, a high temperature, high pressure is employed at an inlet to the combustor. High temperature at the inlet to the combustor leads to a casual increase of the combustion temperature, which brings about a rising concern that NOx in the exhaust gases may eventually increase.

In view of the above, a complex combustion system has come to be suggested, in which a lean pre-mix combustion system effective to reduce the NOx emission level and a diffusive combustion system excellent in ignition performance and flame holding performance are combined together (See, for example, the Patent Documents 1 and 2 listed below). The lean pre-mix combustion system referred to above has such an advantage that since an air/fuel mixture, prepared by pre-mixing air and fuel to have a uniform fuel concentration, is burned, there is no combustion region, at which the flame temperature is locally high, and since the fuel is leaned, the flame temperature can be totally lowered and the amount of NOx emitted can be effectively reduced. However, the lean pre-mix combustion system has such a problem that since large amounts of air and fuel are uniformly mixed, the local fuel concentration in the combustion region tends to become lean, accompanied by lowering of the combustion stability, that is, the flame holding capability particularly at a low load condition. On the other hand, the diffusive combustion system referred to above has such an advantage that since fuel and air are burned while being diffused and mixed, the blow off will hardly occur even at a low load condition while the flame holding capability is excellent. Accordingly, the complex combustion system referred to above is of a type, in which at starting and also at a low load condition the diffusion combustion is utilized to secure the combustion stability and, on the other hand, at a high load condition the pre-mix gas combustion is utilized to reduce the NOx emission level.

A combustor in accordance with related art utilizing the complex combustion system makes use of, for example, as shown in FIG. 6, a burner unit 85 including a diffusive fuel burner (pilot burner) 84, which is operable to inject a diffusive fuel into the combustion chamber and is arranged at a top portion of a combustion liner 81 of the combustor 80, and a pre-mix fuel burner (main burner) 82 for injecting a pre-mix gas into the combustion chamber so as to surround the outside of the injected diffusive fuel. The pilot burner 84 employed therein is in the form of a swirling type burner including an air injecting port 84*b* for injecting a stream of air A, which has become a swirling flow through a swirler 86, around a fuel injecting port 84*a* at the center thereof.

[Patent Document 1] JP Laid-open Patent Publication No. H08-28871

[Patent Document 2] JP Laid-open Patent Publication No. H08-210641

SUMMARY OF THE INVENTION

It has, however, been found that the related art combustor utilizing the swirling type pilot burner 84 discussed above has some problems, which will now be discussed. In the related art combustor, when the flame holding is desired to be enhanced, setting must be done to intensify the reverse flow R1 occurring in the pre-mix gas stream, by the utilization of, for example, swirling. When this setting is employed, combustion gases will be blown onto components at the center of the pilot burner, which will lead to burnout of the pilot burner. On the other hand, when in order to avoid the burnout the swirling is suppressed to weaken the reverse flow R1 which will occur in the pre-mix gas stream, the flame holding capability will be reduced. In other words, although in terms of avoidance of the burnout, suppression of the swirling to weaken the reverse flow R1 occurring in the pre-mix gas stream is necessary, this leads to reduction in flame holding capability. For this reason, the extent to which the pre-mix gas fuel concentration can be lean is limited and, accordingly, the NOx emission level tends to be high.

The present invention has for its object to provide a combustor, in which a flame holding region is formed at a location distant from the pilot burner to thereby avoid any possible burnout of the pilot burner and in which the flame holding capability is increased to permit the use of a leaned pre-mix gas for the purpose of reducing the NOx emission level.

In order to accomplish the foregoing object of the present invention, there is provided a combustor, which includes a combustion liner having a cylindrical side wall that defines a combustion chamber inside thereof; a main burner positioned at a top portion of the combustion liner for injecting a pre-mix gas in an annular shape into the combustion chamber to thereby form a reverse flow region at a location downstream with respect to flow of the pre-mix gas, the reverse flow region being oriented towards the top portion of the combustion chamber along a longitudinal axis of the combustion chamber; and a pilot burner arranged at the top portion for injecting a mixture of fuel and air only in a direction confronting the reverse flow region within the combustion chamber. It is to be noted that the wording "only in a direction confronting the reverse flow region" referred to above is intended to means that the stream of the mixture injected from the pilot burner does not contain any component that forms a region of reverse flow of it such as contained in the conventional pilot burner, that is, contain only a flow component uniform along the longitudinal axis of the combustion chamber.

According to the present invention, since the stream of the mixture emerging outwardly from the pilot burner does not form any reverse flow region and, therefore, the flame holding region can be formed at a location distant from the burner. In view of this, even if the flow velocity is increased to enhance the flame holding capability, there is no possibility that component parts at the center of the burner will not be burned out, which will otherwise occur when high temperature combustion gases are blown onto those component parts at the center of the burner. Also, since the velocity of flow of the mixture from the pilot burner is reduced down to a value equal to or about equal to the velocity of propagation of flames because the stream of the pre-mix gas from the pilot burner is blown onto the pre-mix gas stream then flowing backwardly from the main burner, the flame holding capability can be further increased. As a result, the combustor can be operated with the mixture from either the main burner or the pilot burner leaned to such an extent as to result in reduction in adiabatic flame temperature and, therefore, the low NOx combustion can be achieved.

In one embodiment of the present invention, the pilot burner referred to above may include a porous member having a multiplicity of pores defined therein and operable to inject the pre-mix gas of fuel and air through the porous member. When it comes to the use of the porous member for the pilot burner, effects of avoiding any possible burnout of the pilot burner and of realization of the low NOx combustion can be obtained when the structure of the conventional combustor is simply modified or altered. Also, since the pre-mix gas stream, in which fuel and air are sufficiently mixed together to have a uniform fuel concentration, is jetted from the pilot burner, the amount of NOx emitted can be further reduced.

The pilot burner referred to above may include a pre-mixing member provided in a pre-mix gas passage defined in the pilot burner, and having a multiplicity of pores defined therein for facilitating mixing of fuel and air. The presence of the pre-mix gas passage of a kind having the multiplicity of pores defined therein is effective in that the pre-mix gas of fuel and air, then flowing through the pre-mix gas passage in the pilot burner, produces a turbulent flow as it pass through a pre-mixing member and the fuel and the air can therefore be more uniformly mixed together, and, therefore, the amount of NOx emitted can be further reduced.

Where the pilot burner also employs the pre-mix combustion system as hereinabove described, it is preferred that the main burner has an annular pre-mix gas passage defined therein and the pre-mix gas passage of the pilot burner is arranged inwardly of an inner periphery of the annular pre-mix gas passage of the main burner. This is particularly advantageous in that the pre-mix gas passage of the pilot burner can be employed by the effective utilization of a space available inwardly of the annular pre-mix gas passage of the main burner, and, therefore, the combustor can be assembled compact in size.

In another embodiment of the present invention, the pilot burner may be adapted to inject the pre-mix gas at an initial velocity higher than a velocity of propagation of flame so as to form a flame holding region, at which the velocity of flow of the pre-mix gas is reduced down to a value equal to the velocity of propagation of flame, at a location spaced from the pilot burner in a direction axially of the pilot burner. By so doing, any possible burnout of the pilot burner can be avoided assuredly. The velocity of propagation of the flames can be controlled by adjusting the fuel concentration.

The pilot burner referred to above preferably includes a pilot nozzle for guiding an injection gas therefrom in a direction towards the combustion chamber. The use of the pilot nozzle in the pilot burner is effective to allow the pre-mix gas from the pilot burner to be assuredly jetted in one direction.

The combustor according to one embodiment of the present invention may further include fuel supply systems provided separately in the main burner and the pilot burner, respectively, for supplying fuel and capable of adjusting respective fuel concentrations independently from each other. Although adjustment of the fuel concentration results in control of the velocity of propagation of the flames, the position at which the flame holding region is formed can be properly controlled when the velocity of propagation of the flames of the pre-mix gas jetted from the main burner and the velocity of propagation of the flames of the mixture emerging from the pilot burner that confronts the main burner are made controllable independently. Accordingly, the burnout of the pilot burner can be assuredly avoided and the low NOx combustion can be realized.

In a further preferred embodiment of the present invention, the pilot burner may include a backfire preventing structure for preventing flames from propagating from the combustion chamber. This backfire preventing structure may be a porous member having a plurality of throughholes defined therein. The use of the backfire preventing structure is effective to prevent the flames from back flowing into the pilot burner to thereby effectively avoid any possible burnout of the pilot burner.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE PREFERRED EMBODIMENTS

Figure 1:
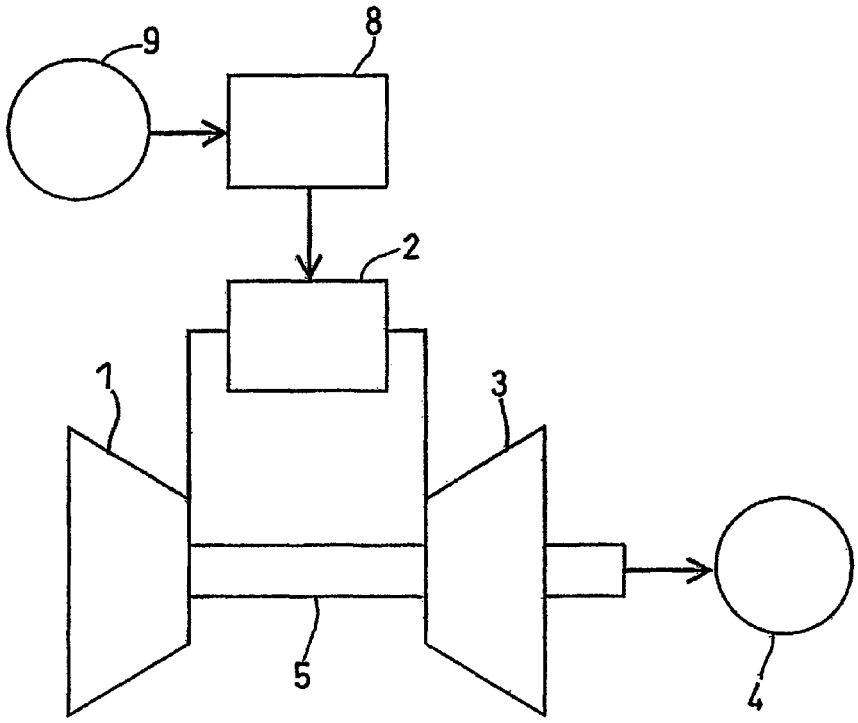
FIG. 1 is a schematic diagram showing a gas turbine engine, in which a combustor according to one embodiment of the present invention is adopted.

Embodiments of the present invention will be described in detail with particular reference to the accompanying drawings. In particular, FIG. 1 illustrates a schematic diagram showing a gas turbine engine, in which a combustor according to a first embodiment of the present invention is adopted. The gas turbine engine GT shown therein has three principal components including a compressor 1, a combustor 2 and a turbine 3, all of which are so operatively linked that a compressed air supplied from the compressor 1 is burned within the combustor 2 to generate a high pressure combustion gas that is subsequently supplied to the turbine 3. The compressor 1 is drivingly coupled with the turbine 3 through a rotary shaft 5 and is therefore driven by the turbine 3. An output from this gas turbine engine GT is utilized to drive a load 4 such as, for example, an aircraft rotor or an electric generator. The combustor 2 is supplied with a fuel from a fuel supply source 9 through a fuel control unit 8. Although the combustor 2 is available in a can type and an annular type, reference will be made to the can type in the following description of the preferred embodiments of the present invention. It is, however, to be noted that the present invention may be equally applied to the annular type.

Figure 2:
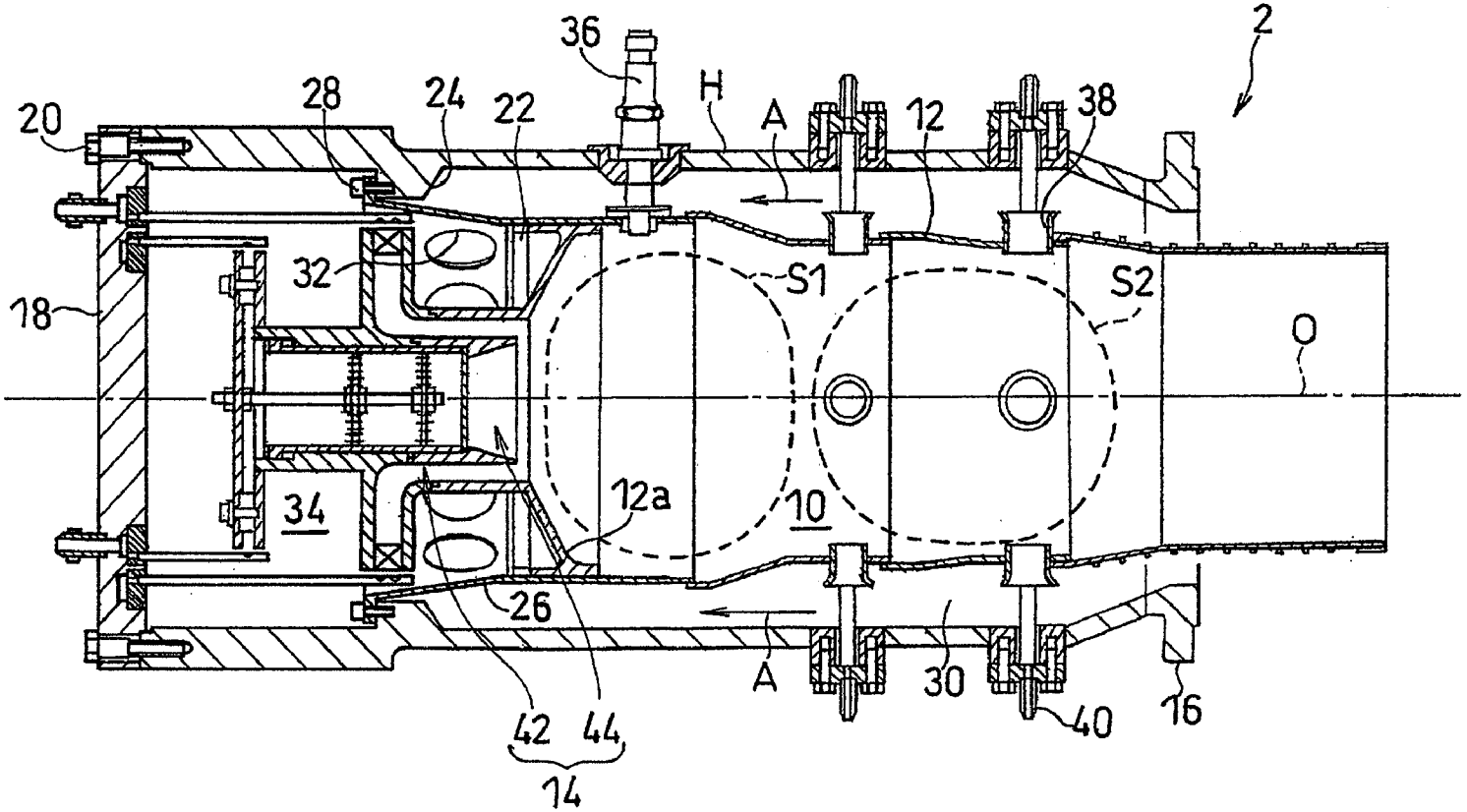
FIG. 2 is a fragmentary longitudinal sectional view showing the combustor shown in FIG. 1.

FIG. 2 shows a longitudinal sectional view of the combustor 2 according to the embodiment shown in and described with reference to FIG. 1. The combustor 2 shown therein is of a type arranged in a plural number in an annular shape about an axis of rotation of the engine and includes a combustion liner 12 having a combustion chamber 10 defined therein, and a burner unit 14 mounted on a top portion 12*a* of the combustion liner 12 for injecting an air/fuel mixture into the combustion chamber 10. The combustion liner 12 and the burner unit 14 are accommodated coaxially within a generally cylindrical housing H, which forms an outer casing for the combustor 2. The housing H has a radially outwardly protruding flange 16 provided at a downstream portion thereof, and is connected by means of bolts (not shown) with a main housing (not shown) of an engine body, including the compressor 1 and the turbine 3, through the flange 16. On the other hand, the housing H has an upstream end to which an end cover 18 is secured by means of bolts 20. It is to be noted that the detail of the structure of a burner unit 14 will be described later.

The housing H has an inner peripheral wall formed with an annular inner flange 24 on an upstream side thereof, which protrudes radially inwardly of the housing H. The combustion liner 12 has a tubular support body 26 extending therefrom, and the combustion liner 12 is secured at an upstream end portion thereof to the housing H with the support body 26 rigidly connected with the inner flange 24 by means of bolts 28. On the other hand, a downstream end portion of the combustion liner 12 is supported by an inlet portion of a transition duct (not shown), which defines a combustion gas introducing passage leading to a turbine unit. The housing H and the combustion liner 12 cooperatively define therebetween an annular air passage 30 for introducing the compressed air from the compressor 1 in a direction, as shown by arrow headed lines A, towards upstream side of the combustion liner 12. Also, the support body 26 has a plurality of air introducing holes 32 defined in a peripheral wall thereof in a direction circumferentially thereof so as to open into the annular air passage 30 so that the compressed air A flowing through the annular air passage 30 can be introduced into an air introducing space 34 delimited between the support body 26 and the end cover 18.

An upstream wall portion of the combustion liner 12 is provided with One or a plurality of ignition plugs 36, which are mounted on the housing H so as to extend completely through the wall of the housing H so that the air/fuel mixture injected from the burner unit 14 can be ignited to form a first combustion region S1 within an upstream area of the combustion liner 12. Also, the combustion liner 12 is provided with a plurality of short tubes extending completely through the peripheral wall thereof on a downstream side of the first combustion region S1, each tubes defining a dilution air hole 38. On the other hand, supplemental burners 40, employed as secondary burners, are mounted on respective portions of the wall of the housing H, aligned with the associated dilution air holes 38, with their tips positioned inside the dilution air holes 38. The supplemental burners 40 are operable to inject fuel into the combustion liner 12 through the dilution air holes 38 so that a second combustion region S2 is formed within the combustion chamber 10 at a location downstream of the first combustion region S1.

Figure 3:
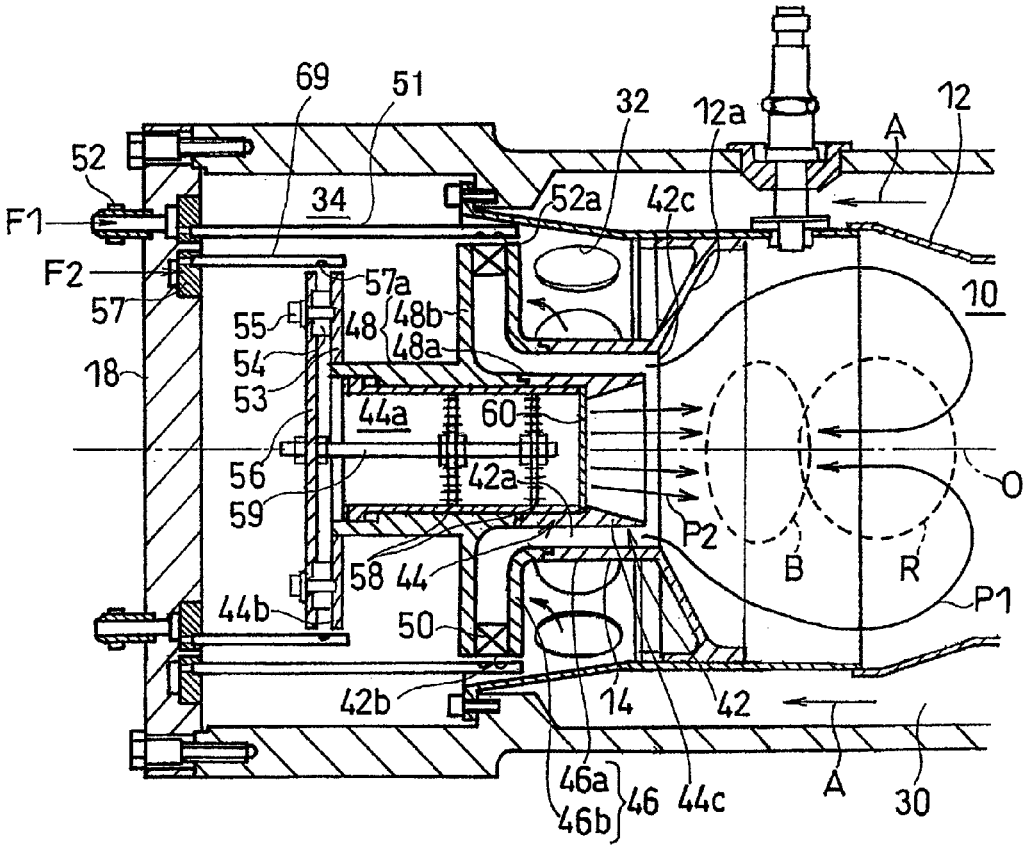
FIG. 3 is a longitudinal sectional view showing an important portion of the combustor shown in FIG. 2.
Figure 6:
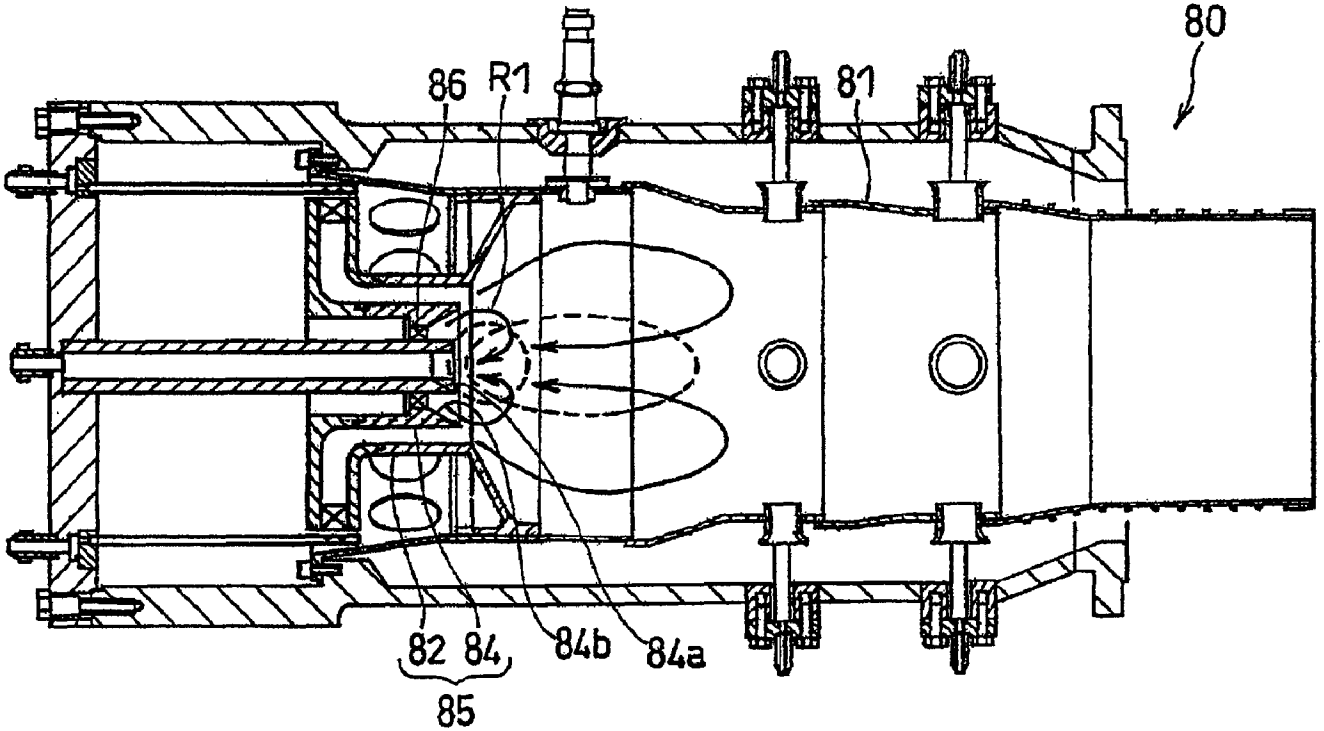
Fig. 6 Prior Art
FIG. 6 is a longitudinal sectional view showing a combustor according to related art.

FIG. 3 illustrates a fragmentary longitudinal sectional view showing an important portion of the combustor 2 shown in FIG. 2. The burner unit 14 includes a main burner 42 for injecting an annular pre-mix gas stream P1 containing a swirling stream component and a pilot burner 44 arranged inside the main burner 42. The pilot burner 44 is operable to inject a pre-mix gas stream P2, shown in FIG. 3, only in a direction along the longitudinal axis O of the combustor 2, that is, in such a direction that no reverse flow R1 induced by the conventional swirling type burner shown in FIG. 6 will not occur. More specifically, the burner unit 14 referred to above includes an outer burner tube 46 and an inner burner tube 48. The outer burner tube 46 includes an outer peripheral cylindrical portion 46*a*, which is coaxial with the longitudinal axis O of the combustor 2 which also defines a longitudinal axis of the combustion liner 12, and an outer peripheral disc portion 46*b* extending from an upstream end of the outer peripheral cylindrical portion 46*a* in a direction perpendicular to the longitudinal axis O so as to represent an annular plate shape. On the other hand, the inner burner tube 48 referred to above includes an inner peripheral cylindrical portion 48*a* positioned radially inwardly of the outer cylindrical portion 46*a* in coaxial relation therewith, and an inner peripheral disc portion 48*b* positioned upstream of the outer peripheral disc portion 46*a* and extending from a portion of the inner peripheral cylindrical portion 48*a* in the vicinity of an upstream end portion of the inner peripheral cylindrical portion 48*a* in a direction parallel to the outer peripheral disc portion 46*b*. A space delimited between the outer burner tube 46 and the inner burner tube 48 forms a first annular pre-mix gas passage 42*a* of the main burner 42 and a space within the inner burner tube 48 forms a second pre-mix gas passage 44*a* of the pilot burner 44. Accordingly, the combustion liner 12, the main burner 42 and the pilot burner 44 share the longitudinal axis O with each other.

A radially outwardly oriented first introducing port 42*b* is formed at the most upstream portion of the first pre-mix gas passage 42*a* in the main burner 42, that is, adjacent the outermost periphery of each of the two disc portions 46*b* and 48*b*. A first fuel supply passage 52 for supplying a fuel F1 therethrough is disposed radially outwardly of the first introducing port 42 and extends completely through the end cover 18. A downstream portion of the first fuel supply passage 52, which is positioned within the air introducing space 34, is defined by a plurality of first fuel tubes 51 connected with the end cover 18 and arranged about the longitudinal axis O in an equidistantly spaced relation to each other. Each of those first fuel tubes 51 has its downstream end portion formed with a first fuel injecting port 52*a*, which confronts the first introducing port 42*b*. The first introducing port 42*b* has a swirler 50 in the form of stationary vanes fixedly embedded therein, which swirler 50 is operable to swirl the air and the fuel both introduced into the first pre-mix gas passage 42*a*. When the air and the fuel introduced into the first pre-mix gas passage 42*a* are swirled within the first pre-mix gas passage 42*a* as hereinabove described, the both are mixed to form an air/fuel pre-mix gas, which is subsequently injected from an injection port 42*c*, in the form of an opening at a downstream end of the first pre-mix gas passage 42*a*, into the combustion chamber 10 as a swirling stream about the longitudinal axis O of the combustor 2. A pre-mix gas stream P1 so injected forms, at a downstream location with respect to the direction of flow of the pre-mix gas stream, a reverse flow region R oriented towards a top portion 12*a* of the combustion liner 12 along the longitudinal axis O of the combustion chamber 10. It is to be noted that in order to generate the swirling stream of the pre-mix gas, a baffling plate, for example, may be provided at an outlet portion of the burner in place of the swirler 50 employed in the practice of the embodiment of the present invention.

The second pre-mix gas passage 44*a* of the pilot burner 4 further extends from an upstream end portion of the inner burner tube 48 in a direction radially outwardly thereof in the form of a disc shape. An upstream portion of this second pre-mix gas passage 44*a* is defined between a first passage defining plate 53 of an annular shape and a second passage defining plate 56 of a disc shape fitted to the first passage defining plate 53 through a spacer 54 by means of bolts 55 so as to confront axially. The second pre-mix gas passage 44*a* has its upstream end defining a second introducing port 44*b*, and a second fuel supply passage 57 for supplying the fuel F2 therethrough is defined radially outwardly of the second introducing port 44*b* and extends through the end cover 18. As is the case with the first fuel supply passage 52, the second fuel supply passage 57 does as well have a downstream portion formed by a plurality of second fuel tube 69, and each of those second fuel tubes 69 has its downstream end portion formed with a second fuel injecting hole 57*a* that confronts the second introducing port 44*b*.

It is to be noted that the first fuel supply passage 52 for supplying the fuel towards the main burner 42, which includes the first pre-mix gas passage 42*a*, the first introducing port 42*b* and the injection port 42*c*, and the second fuel supply passage 57 for supplying the fuel towards the pilot burner 44, which includes the second pre-mix gas passage 44*a*, the second introducing port 44*b* and a pilot nozzle 44*c*, are employed as fuel supply systems separate and independent from each other such that the fuel concentrations (air/fuel mixing ratios) of the air/fuel mixtures in those fuel supply systems can be adjusted independently when the flow of the fuel in the first fuel supply passage 52 and the flow of the fuel in the second fuel supply passage 57 are independently controlled.

Figure 4:
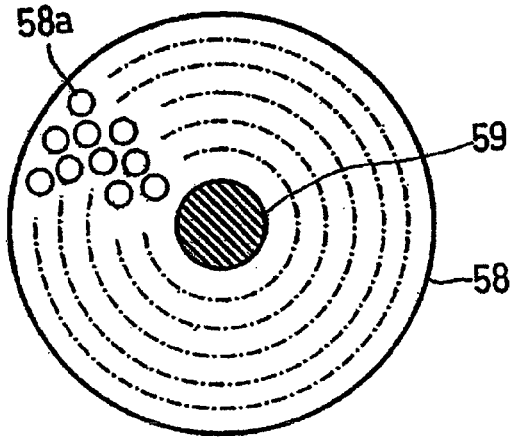
FIG. 4 is a schematic front elevational view showing a pre-mixing member used in the combustor shown in FIG. 2.

The second pre-mix gas passage 44*a* of the pilot burner 44 is provided with two pre-mixing members 58 that lie perpendicular to the longitudinal axis O. Each of the pre-mixing members 58 is, as best shown in FIG. 4, in the form of a flat metallic plate having a plurality of throughholes 58*a* defined therein. Those two pre-mixing members 58 are mounted on a support rod 59, extending in alignment with the longitudinal axis O of the combustor 2 and fixed to the second passage defining plate 56 by means of nuts, in a fashion spaced a distance from each other in an axial direction along the longitudinal axis O. The mixture of fuel and air flowing through the second pre-mix gas passage 44*a* generates a turbulent flow, as it flows successively through the throughholes in the pre-mixing members 58, and is therefore uniformly mixed. It is to be noted that although in the foregoing embodiment of the present invention reference has been made to the use of the two pre-mixing members 58, the number of the pre-mixing member 58 may not be necessarily limited to such as shown and described and, instead, one or three or more of the pre-mixing members may be employed, or the pre-mixing member may be dispensed with.

The pilot nozzle 44*c* referred to above is formed in the most downstream end of the inner burner tube 48, which forms a pre-mix gas injecting unit for the pilot burner 44. This pilot nozzle 44*c* has an inner peripheral wall flaring axially outwardly in a direction downstream thereof. A porous member 60 having a multiplicity of pores or throughholes defined therein is secured to an upstream end portion of the pilot nozzle 44*c* so as to lie perpendicular to the longitudinal axis O and also as to cover the entire section of the second pre-mix gas passage 44*a*. In the illustrated embodiment, for the porous member 60, a plate similar to the pre-mixing member 58 is employed. The pre-mix gas stream flowing through the second pre-mix gas passage 44*a* for the pilot burner 44 is, after having been rectified to provide a uniform stream, supplied into the pilot nozzle 44*c*. The pre-mix gas stream so emerging outwardly from the pilot nozzle 44*c* is guided by the tapered inner peripheral wall of the pilot nozzle 44*c* so as to flow into the combustion chamber 10 in a direction confronting the reverse flow region R. In this way, the pre-mix gas P2 emerging outwardly from the pilot burner 44 does not contain swirling stream component and is injected only in the direction confronting the reverse flow region R. It is to be noted that the inner peripheral surface of the pilot nozzle 44*c* may not be axially outwardly tapered such as shown and described, but may be a cylindrical surface. Also, such a structure may be employed, in which the pilot nozzle 44*c* is dispensed with and, instead, the pre-mix gas P2 may be injected directly from the porous member 60 into the combustion chamber 10.

For the porous member 60, any suitable member may be employed, provided that it be formed with a multiplicity of throughholes through which the pre-mix gas can flow in a direction substantially parallel to the longitudinal axis O of the combustor 2 so as to confront the reverse flow region R. By way of example, a punched plate or a plate, which is perforated by means of a drilling, electric discharge machining, laser perforating or water-jet boring technique, a porous sintered metal, made by sintering a powder of metal, metallic fibers and/or metallic nets, a porous metal, a metal knit that is plain woven or three dimensionally woven, or a porous ceramic material may be used therefor. The porous member 60 may not be always limited to a planar shape, but may be of a curved shape. Also, material for the porous member 60 may be a heat resistant material such as, for example, steel, cast iron or a heat resistant metal (Hastelloy, HA188 or Fecralloy), or a ceramic material.

For the pre-mixing member 58, any suitable material may be used, provided that it has a multiplicity of throughholes necessary to facilitate pre-mixing. By way of example, a punched plate or a plate, which is perforated by means of a drilling, electric discharge machining, laser perforating or water-jet boring technique, a porous sintered metal, made by sintering a powder of metal, metallic fibers and/or metallic nets, a porous metal, a metal knit that is plain woven or three dimensionally woven, or a porous ceramic material may be used therefor. The porous member 60 may not be always limited to a planar shape, but may be of a curved shape. Also, material for the porous member 60 may be a heat resistant material such as, for example, steel, cast iron or a heat resistant metal (Hastelloy, HA188 or Fecralloy), or a ceramic material.

In addition, in the pilot burner 4 of the structure hereinabove described, the initial velocity at the time the pre-mix gas P2 is injected can be adjusted by varying the diameter and the number of pores in the porous member 60. On the other hand, the velocity of propagation of flame may be adjusted by controlling the fuel concentration of the pre-mix gas. Accordingly, by choosing the initial velocity of flow of the pre-mix gas P2 jetted from the pilot burner 44 to be higher than the velocity of propagation of the flame, the flame holding region B, which is formed at a location where the velocity of flow of the pre-mix gas P2 is lowered to a value equal to the velocity of propagation of the flame, may be shifted to a location separated a distance away from the pilot burner 44 in a direction along the longitudinal axis O of the combustor 2.

In the embodiment hereinabove described, with the pore size and the number of the throughholes in the porous member 60 being adjusted to set the initial velocity of flow of the pre-mix gas P2 to be higher than the velocity of propagation of the flame, the backfire phenomenon, in which flames in the flame holding region B propagate into the burner unit 14, is avoided. In other words, the porous member 60 in such case serves as a backfire preventing structure for the combustor 2. Also, even when the hole size of the porous member 60 is chosen to be equal to or smaller than the critical diameter which represents the smallest diameter at which the flames can propagate (for example, 3 mm in the case of the fuel containing methane as a principal component), propagation of the flame into the burner unit 14 can be avoided. Therefore, it is possible to allow the porous member 60 to function as a backfire preventing structure.

In the next place, the operation of the combustor 2 according to the foregoing embodiment of the present invention will be described. As best shown in FIG. 3, the fuel F1 supplied from the first fuel supply passage 52, together with the compressed air A introduced into the air introducing space 34 through the air passage 30 located radially outwardly of the combustion liner 12 and then through the air introducing holes 32, is introduced into the first pre-mix gas passage 42*a* through the first introducing port 42*b* of the main burner 42. The mixture of the fuel F1 and the compressed air A so introduced into the first pre-mix gas passage 42*a* swirls, as it flow past the swirler 50, to form a diluted pre-mix gas which is subsequently jetted from the injection port 42*c* of the main burner 42 into the combustion chamber 10 as the pre-mix gas stream P1. Since the pre-mix gas stream P1 is a flow swirling about the longitudinal axis O of the combustor 2, the pre-mix gas stream P1 spreads radially outwardly by the effect of a centrifugal force developed therein and subsequently circulates, to flow towards the longitudinal axis O around which the pressure thereof is lowered and then towards the top portion 12*a* of the combustion liner 12 along the longitudinal axis O. In this way, the reverse flow region R is formed along the longitudinal axis O of the combustor.

On the other hand, the fuel F2 supplied from the second fuel supply passage 57 is, together with the compressed air A, introduced into the second pre-mix gas passage 44*a* through the second introducing port 44*b* of the pilot burner 44 in a manner similar to the main burner 42 described above. This fuel F2 and the compressed air A are not swirled within the pilot burner 44, but are mixed together as they flow through the throughholes of the two pre-mixing members 58 to thereby provide a uniform pre-mix gas. This pre-mix gas is subsequently rectified as it flow through the pores of the porous member 60 and is then jetted from the pilot nozzle 44*c* into the combustion chamber 10 after having been guided along the outwardly tapered inner peripheral wall. Since at this time, the second pre-mix gas passage 44*a* of the pilot burner 44 is disposed inwardly of the annular first pre-mix gas passage 42*a* of the main burner 42, the pre-mix gas P2 jetted through the porous member 60 in a direction along the longitudinal axis O forms a gas flow confronting the reverse flow region R. Also, since the pre-mix gas P2 emerging outwardly from the pilot burner 44 contains substantially no swirling stream component, whereby no reverse flow occurs even though the velocity of flow of the pre-mix gas P2 is increased in order to increase the flame holding capability, blowing of the combustion gases towards mainly the pilot burner 44 of the burner unit 14 will be avoided and, hence, any possible burnout of the burner unit 14 can be prevented. In addition, since it is possible to maintain or increase the flame holding capability without the velocity of flow of the pre-mix gas P2 being lowered, the flame holding capability can be secured even when the fuel concentration of the pre-mix gas is leaned and the adiabatic flame temperature can be reduced, allowing the amount of NOx eventually emitted to be reduced.

In such case, setting of the initial velocity of flow of the pre-mix gas P2, jetted from the pilot burner 44, to a value higher than the velocity of propagation of the flames is more effective. In other words, by adjusting the hole size and the number of the pores in the porous member 60 to thereby control the initial velocity of flow of the pre-mix gas P2 and, on the other hand, by adjusting the fuel concentration of the pre-mix gas to thereby control the velocity of propagation of the flame, it is possible to set the velocity of flow of the pre-mix gas P2 at the time of flow from the pilot nozzle 44*c* into the combustion chamber 10 to a value sufficiently higher than the velocity of propagation of the flame. The pre-mix gas P2 having such initial velocity and flowing into the combustion chamber 10 flares radially outwardly, with the section of passage thereof gradually increasing, as it flows within the pilot nozzle 44*c* in a direction downstream thereof. As the pre-mix gas P2 flows into the combustion chamber 10, the section of passage thereof further increases abruptly, accompanied by reduction in velocity of flow thereof. The velocity of flow of the pre-mix gas P2 is further reduced down to a value equal to or about equal to the velocity of propagation of the flame when the pre-mix gas P2 collides against the pre-mix gas P1, which is a reverse flow from the main burner 42. Considering that the flame holding region B at which the flame is hold stably is formed at a location where the velocity of flow of the pre-mix gas P2 is down to the value equal to or about equal to the velocity of propagation of the flames, this flame holding region B is formed at the position spaced a distance from the burner unit 14 along the longitudinal axis O and, therefore, any possible burnout of the various component parts of the burner unit 14 by the effect of heat of the flames can be avoided.

Furthermore, in the embodiment hereinabove described, when the pre-mix gas emerging from the pilot burner 44 is blown into the pre-mix gas then flowing backwardly from the main burner 42, the velocity of flow of the pre-mix gas from the pilot burner 44 can be lowered down to a value equal to or about equal to the velocity of propagation of the flames and, therefore, the flame holding capability can be increased further. As a result, it is possible to reduce the amount of NOx emitted as a result of combustion, by diluting the fuel concentration of the pre-mix gas. It is pointed out that when a series of experiments were conducted to compare the amount of NOx emitted as a result of combustion, exhibited by the combustor having the conventional burner structure shown in FIG. 6, and that exhibited by the combustor according to the previously described embodiment of the present invention, the amount of NOx emitted by the combustor of the present invention was about half that exhibited by the combustor utilizing the conventional burner structure.

Figure 5:
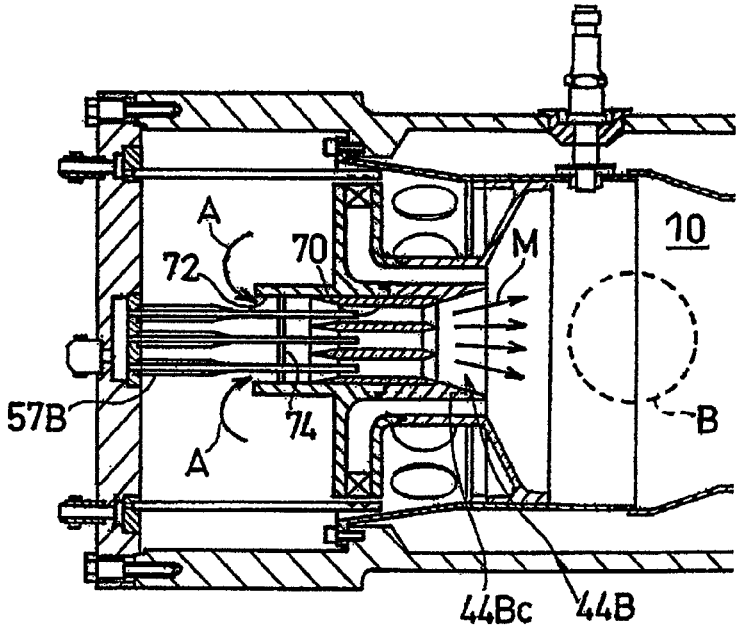
FIG. 5 is a fragmentary longitudinal view showing an important portion of the combustor according to another preferred embodiment of the present invention.

It is to be noted that although in the foregoing embodiment of the present invention, a system of injecting the pre-mix gas P2 through the porous member 60 has been shown and described as employed in the pilot burner 44, a pilot burner 44B of a dispersive injection type as shown in FIG. 5 may be employed in place of the pilot burner 44. This pilot burner 44B is so designed and so operable that a fuel F2 fed from a plurality of second fuel supply passage 57B can be introduced directly into a plurality of mixing holes 70 arranged in the vicinity of an upstream end of a pilot nozzle 44Bc and a gaseous mixture M of the fuel F2 with a compressed air 44B then introduced into the mixing holes 70 through an air introducing port 72 and then through a perforated rectifying plate 74 can be jetted into the combustion chamber 10. Even with the pilot burner 44B of the structure shown in and described with reference to FIG. 5, by injecting the air/fuel mixture only in a direction counter to the reverse flow region R, the flame holding region B can be formed at a position distant from the burner unit 14 so that not only can any possible burnout of the burner unit 14 be avoided, but also an effect of reducing the NOx emission level with the pre-mix gas further leaned can be obtained.

Although in describing the foregoing embodiment of the present invention, the combustor 2 has been shown and described as applied to the gas turbine engine GT, but the combustor of the present invention can be applied not only to the gas turbine engine, but also to any other machine or equipment such as, for example, a boiler that requires the supply of a high temperature gaseous medium.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A combustor comprising:

a combustion liner having a cylindrical side wall that defines a combustion chamber inside thereof;

a main burner positioned at an inlet end of the combustion liner for injecting a pre-mix gas as a flow swirling about a longitudinal axis of the combustor in an annular shape into the combustion chamber to thereby form a reverse flow region at a location downstream with respect to flow of the pre-mix gas, in which at least a portion of the flow of the pre-mix gas flows in an upstream direction from a downstream location within the combustion chamber towards the inlet end of the combustion chamber along a longitudinal axis of the combustion chamber; and a pilot burner arranged at the inlet end for injecting a pre-mix gas of fuel and air in a single direction confronting the portion of the flow of the pre-mix gas flowing in the upstream direction within the combustion chamber;

wherein the pilot burner injects the pre-mix gas at an initial velocity higher than a velocity of propagation of flame so as to form a flame holding region, at which the velocity of flow of the pre-mix gas is reduced down to a value equal to the velocity of propagation of flame, at a location spaced from the pilot burner in a direction axially of the pilot burner, and wherein the pilot burner includes a pilot nozzle formed in a most downstream end thereof and having an inner peripheral wall flaring axially outwardly in a direction downstream thereof, and a porous member, provided at an upstream end portion of the pilot nozzle, in the shape of a plate having a multiplicity of pores defined therein and is operable to inject the pre-mix gas of fuel and air through the porous member.

2. The combustor as claimed in claim 1, wherein the pilot burner includes a pre-mixing member provided in a pre-mix gas passage defined in the pilot burner and having a multiplicity of pores defined therein for facilitating mixing of fuel and air to create the pre-mix gas of fuel and air injected through the porous member.

3. The combustor as claimed in claim 2, wherein the pilot burner includes a support rod arranged on a longitudinal axis thereof and the plurality of pre-mixing members are mounted on the support rod so as to be positioned spacedly from each other in a direction axially of the pilot burner.

4. The combustor as claimed in claim 1, wherein the main burner has a first pre-mix gas passage defined therein that accommodates the pre-mix gas, and a second pre-mix gas passage of the pilot burner that accommodates the pre-mix gas of fuel and air is arranged inwardly of an inner periphery of the first pre-mix gas passage of the main burner.

5. The combustor as claimed in claim 1, wherein the pilot burner includes a pilot nozzle for guiding an injection gas therefrom in a direction towards the combustion chamber.

6. The combustor as claimed in claim 1, further comprising:

a first fuel supply system that provides fuel to the main burner to create the pre-mix gas; and a second fuel supply system that provides fuel to the pilot burner to create the pre-mix gas of fuel and air;

wherein the first fuel supply system and the second fuel supply system supply fuel to the main burner and pilot burner, respectively, independently of each other; and wherein the first fuel supply system and the second fuel supply system are configured to adjust a concentration of the fuel provided to the main burner and the pilot burner, respectively, independently of each other.

7. The combustor as claimed in claim 1, wherein the pilot burner includes a backfire preventing structure for preventing flame from penetrating from the combustion chamber.

8. The combustor as claimed in claim 7, wherein the backfire preventing structure is formed by a porous member having a plurality of throughholes defined therein.

9. The combustor as claimed in claim 1, wherein the pilot burner includes an introducing port defined at an upstream end of the pilot burner for introducing a fuel and an air thereinto, a pre-mix gas passage formed on a downstream side of the introducing port for pre-mixing the fuel and the air and a pre-mix gas injecting unit formed on a downstream side of the pre-mix gas passage for injecting the pre-mix gas through a porous member having a multiplicity of pores defined therein.

* * * * *